US010941774B2

(12) United States Patent
Jiang et al.

(10) Patent No.: US 10,941,774 B2
(45) Date of Patent: Mar. 9, 2021

(54) VARIABLE-CAPACITY MECHANISM OF SCROLL COMPRESSOR AND SCROLL COMPRESSOR

(71) Applicant: GREE ELECTRIC APPLIANCES, INC. OF ZHUHAI, Zhuhai (CN)

(72) Inventors: Guobiao Jiang, Zhuhai (CN); Xiaolei Li, Zhuhai (CN); Caixia Shan, Zhuhai (CN); Yusheng Hu, Zhuhai (CN); Qi Fang, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 303 days.

(21) Appl. No.: 15/767,788

(22) PCT Filed: Sep. 28, 2016

(86) PCT No.: PCT/CN2016/100558
§ 371 (c)(1),
(2) Date: Apr. 12, 2018

(87) PCT Pub. No.: WO2017/063503
PCT Pub. Date: Apr. 20, 2017

(65) Prior Publication Data

US 2018/0298903 A1 Oct. 18, 2018

(30) Foreign Application Priority Data

Oct. 15, 2015 (CN) ..... 201510676945.X

(51) Int. Cl.
*F04C 28/26* (2006.01)
*F04C 18/02* (2006.01)
(Continued)

(52) U.S. Cl.
CPC ..... *F04C 28/26* (2013.01); *F04C 18/02* (2013.01); *F04C 18/0215* (2013.01);
(Continued)

(58) Field of Classification Search
CPC .. F04C 18/02; F04C 18/0215; F04C 18/0253; F04C 23/008; F04C 28/065; F04C 28/26; F04C 28/16
See application file for complete search history.

(56) References Cited

U.S. PATENT DOCUMENTS 4,382,370 A * 5/1983 Suefuji ..... F04C 23/00 62/324.1
4,383,805 A * 5/1983 Teegarden ..... F04C 28/16 417/308
(Continued)

FOREIGN PATENT DOCUMENTS

CN 1272906 A 11/2000
CN 101772646 A 7/2010
(Continued)

OTHER PUBLICATIONS

WIPO, International Search Report dated Dec. 23, 2016.
China Patent Office, Patent search report.

*Primary Examiner* — Patrick Hamo
*Assistant Examiner* — Joseph S. Herrmann
(74) *Attorney, Agent, or Firm* — Li & Cai Intellectual Property (USA) Office

(57) ABSTRACT

Provided is a variable-capacity mechanism for a scroll compressor. The scroll compressor includes a compression mechanism. The compression mechanism includes a fixed scroll and an orbiting scroll for defining a series of compression cavities. The variable-capacity mechanism includes: a discharge channel, suitable for communicating a medium-pressure compression cavity in the compression cavities with a low-pressure region; blocking members, suitable for selectively opening or closing the discharge channel; an actuation device, including an execution member, the blocking members being connected to the execution member so as to selectively open or close the discharge
(Continued)

channel along with the actions of the execution member. Multiple blocking members are connected to a single execution member so as to synchronously move along with the actions of the single execution member. By the variable-capacity mechanism, action synchronization of multiple blocking members can be reliably implemented. Provided is a scroll compressor including the variable-capacity mechanism.

21 Claims, 10 Drawing Sheets

(51) Int. Cl.
*F04C 28/16* (2006.01)
*F04C 28/06* (2006.01)
*F04C 23/00* (2006.01)

(52) U.S. Cl.
CPC ..... *F04C 18/0253* (2013.01); *F04C 28/065* (2013.01); *F04C 28/16* (2013.01); *F04C 23/008* (2013.01)

(56) References Cited

U.S. PATENT DOCUMENTS 6,139,287 A * 10/2000 Kuroiwa ..... F04C 28/16 417/299
6,478,550 B2 * 11/2002 Matsuba ..... F04C 28/16 417/287
6,607,367 B1 * 8/2003 Shibamoto ..... F04C 27/005 417/310
6,619,062 B1 * 9/2003 Shibamoto ..... F04C 29/0014 62/228.3
8,308,448 B2 * 11/2012 Fields ..... F04C 18/0215 417/310
8,328,531 B2 * 12/2012 Milliff ..... F04C 18/0215 417/310
9,869,315 B2 * 1/2018 Jang ..... F04C 18/0215
2006/0093504 A1 * 5/2006 Kim ..... F04C 18/0215 418/55.1
2010/0189585 A1 * 7/2010 Matsukawa ..... F04C 18/0215 418/48
2015/0004039 A1 * 1/2015 Doepker ..... F04C 28/26 418/55.1
2016/0169228 A1 * 6/2016 Jang ..... F04C 29/023 418/55.1

FOREIGN PATENT DOCUMENTS

CN 102086865 A 6/2011
CN 102272454 A 12/2011
CN 203730312 U 7/2014
CN 204386880 U 6/2015
CN 204663878 U 9/2015
CN 105275804 A 1/2016
CN 205047429 U 2/2016
JP H01106990 A 4/1989
JP 1-318777 A 12/1989
JP 9-105386 A 4/1997
JP H10148189 A 6/1998

* cited by examiner

VARIABLE-CAPACITY MECHANISM OF SCROLL COMPRESSOR AND SCROLL COMPRESSOR

CROSS-REFERENCE TO RELATED APPLICATIONS

The present application claims benefit of Chinese Patent Application No. 201510676945.X, entitled "variable-capacity mechanism of scroll compressor and scroll compressor", filed to China Patent Office on Oct. 15, 2015, the contents of which are hereby incorporated by reference in its entirety.

TECHNICAL FIELD

The present invention relates to a variable-capacity mechanism for a scroll compressor and a relevant scroll compressor, and more particularly to a variable-capacity mechanism for a scroll compressor and a relevant scroll compressor, which improve the action synchronization of blocking members of a variable-capacity mechanism and the like.

BACKGROUND

With the increasing demand for high efficiency and energy saving property, high efficiency, energy saving and comfort of air conditioners serving as main energy-consuming products are being constantly pursued. Scroll compressors have gradually developed in a direction of larger horsepower and higher energy efficiency, and because capacity-adjustable (variable-capacity) scroll compressors can achieve high energy efficiency at low loads and are characterized by high reliability and low vibration, they are more and more widely applied in capacity-adjustable air conditioning systems and the like.

A scroll compressor generally includes: a housing; a compression mechanism, including an orbiting scroll and a fixed scroll; a drive mechanism, including a motor, a crankshaft, and an autorotation prevention device; and a support mechanism, including a main bearing seat (upper bearing seat). The profiles of the orbiting and fixed scrolls are both scroll-shaped. The orbiting scroll is eccentric with respect to the fixed scroll and may be mounted, for example, at 180 degrees apart. In this way, theoretically, the orbiting and fixed scrolls will axially contact in several straight lines (in a cross section, they appear to contact at several points). At the same time, the ends of a vortex profile contact the bottom of a corresponding vortex, thereby forming a series of crescent-shaped spaces (i.e., basic capacities or compression cavities) between the orbiting and fixed scrolls. When the orbiting scroll rotates about the center of the fixed scroll and makes a rotational translational motion without autorotation by using a certain rotation radius, an outer crescent-shaped space will continuously move toward the center and the capacity will continuously shrink. At this time, a working fluid (such as refrigerant) in the crescent-shaped space is compressed to make the pressure continuously increased until the crescent-shaped space communicates with a central exhaust hole to discharge a high-pressure working fluid from the compression mechanism.

On the other hand, in a conventional capacity-adjustable scroll compressor, bypass variable-capacity holes communicating with the compression cavity are provided in the scrolls, so that the compression cavity communicates with a suction region (or other low-pressure fluid regions), thereby reducing the displacement of the compression cavity. As a result, partial loads of the compressor are achieved, and thus a capacity adjustment of the compressor is achieved.

However, in a conventional capacity-adjustable scroll compressor, when a capacity adjustment range is larger and it is necessary to add one or more other auxiliary variable-capacity holes, it is necessary to add one or more other sets of variable-capacity activation mechanisms, which results in a complex variable-capacity structure and control system with reduced reliability. In addition, for a symmetrical compression mechanism with a vortex profile symmetry, the provision of multiple sets of variable-capacity actuation mechanisms (such as multiple pistons) is prone to asynchronous movement between the multiple sets of variable-capacity actuation mechanisms, which results in uneven stress on a pump body (compression mechanism), thereby resulting in increased power consumption or leakage.

In addition, in a conventional capacity-adjustable scroll compressor, in particular for a high-pressure-side scroll compressor, it is generally necessary to open a discharge backflow channel on a fixed scroll. Thus, on the one hand, the structure of the fixed scroll affects the cross-sectional area of the discharge backflow channel, thereby resulting in resistance to the discharge of a working fluid, so as to increase power consumption. On the other hand, the discharge backflow channel needs to extend in the scroll radially with a small diameter, thereby resulting in processing difficulties.

In addition, in a conventional capacity-adjustable scroll compressor, the action reliability of a variable-capacity piston or plunger is affected by low action guide accuracy of the variable-capacity piston or plunger and mutual collision between the variable-capacity piston or plunger and an end face of a variable-capacity hole. In addition, when increasing a fitting clearance between the variable-capacity piston or plunger and the variable-capacity hole in order to improve the action reliability, this will lead to leakage of a working fluid.

Here, it should be noted that the technical content provided in the background is intended to aid those skilled in the art in understanding the present invention and does not necessarily constitute the related art.

SUMMARY

Provided here is a general summary of the present invention, not a comprehensive disclosure of a full scope of the present invention or all features of the present invention.

An objective of the present invention is to provide a variable-capacity mechanism for a scroll compressor, capable of reliably implementing the action synchronization of multiple blocking members.

Another objective of the present invention is to provide a variable-capacity mechanism for a scroll compressor, simple in overall structure and capable of improving the reliability of capacity adjustment switching.

Another objective of the present invention is to provide a variable-capacity mechanism for a scroll compressor, capable of avoiding increased power consumption or leakage of a working fluid caused by uneven gas force of a compression mechanism.

Another objective of the present invention is to provide a variable-capacity mechanism for a scroll compressor, capable of reducing discharge resistance and power consumption.

Another objective of the present invention is to provide a variable-capacity mechanism for a scroll compressor, capable of reducing processing difficulty and processing cost.

Another objective of the present invention is to provide a variable-capacity mechanism for a scroll compressor, capable of improving the sealing property of a compression mechanism to improve the energy efficiency of a compressor.

Another objective of the present invention is to provide a variable-capacity mechanism for a scroll compressor, allowing a blocking member to have radial flexibility and/or axial flexibility so as to eliminate the problem of over-positioning to reduce assembly difficulty and part processing accuracy.

Another objective of the present invention is to provide a variable-capacity mechanism for a scroll compressor, allowing a blocking member to have radial flexibility and/or axial flexibility so as to facilitate axial seal of a compression mechanism and to avoid mutual interference between the blocking member and an orbiting scroll.

Other objectives of the present invention are to provide a scroll compressor comprising the above-mentioned variable-capacity mechanism.

In order to achieve one or more of the above objectives, according to an aspect of the present invention, a variable-capacity mechanism for a scroll compressor is provided. The scroll compressor comprises a compression mechanism suitable for compressing a working fluid, the compression mechanism comprising a fixed scroll and an orbiting scroll for defining a series of compression cavities therebetween. The variable-capacity mechanism comprises: a discharge channel, suitable for communicating a medium-pressure compression cavity in the compression cavities with a low-pressure region; blocking members, suitable for selectively opening or closing the discharge channel; and an actuation device, comprising an execution member, the blocking members being connected to the execution member so as to selectively open or close the discharge channel along with the actions of the execution member. There are multiple blocking members, there is a single execution member, and the multiple blocking members are connected to the single execution member so as to synchronously move along with the actions of the single execution member.

Preferably, each of the blocking members is plunger.

Preferably, one end of a plurality of plungers are connected to a lower surface of the execution member.

Preferably, the actuation device further comprises a drive portion, the drive portion comprising a pressure channel, wherein the pressure channel can be selectively supplied with a high-pressure fluid and a low-pressure fluid; and when the pressure channel is supplied with a high-pressure fluid, the high-pressure fluid supplied via the pressure channel pushes the execution member to actuate the execution member.

Preferably, a variable-capacity cylinder connected to a fixed scroll end plate of the fixed scroll is further comprised.

Preferably, an annular slot opened toward the fixed scroll end plate is formed in the variable-capacity cylinder, the execution member being disposed in the annular slot.

Preferably, a communication hole is formed in the variable-capacity cylinder, and the pressure channel communicates with the annular slot via the communication hole so as to introduce the high-pressure fluid to an upper portion of the annular slot to drive the execution member.

Preferably, the discharge channel comprises: multiple first channels formed on the fixed scroll end plate and capable of communicating with the medium-pressure compression cavity; and a second channel disposed on the variable-capacity cylinder and capable of communicating with the first channels and the low-pressure region.

Preferably, each of the first channels comprises a variable-capacity hole and a discharge hole communicating with each other, wherein the variable-capacity hole is formed at a lower portion of the fixed scroll end plate so as to communicate with the medium-pressure compression cavity, and the discharge hole is formed at an upper portion of the fixed scroll end plate; and the plunger is suitable for selectively opening and closing the variable-capacity hole.

Preferably, a guide hole is further comprised, the guide hole being formed at the upper portion of the fixed scroll end plate and capable of communicating with the variable-capacity hole, so that the guide hole and the variable-capacity hole define a movement passage suitable for the movement of the plunger therein.

Preferably, the discharge hole is provided at an upper side of the variable-capacity hole, the discharge hole is a blind hole, and the discharge hole is partially overlapped with the guide hole and communicates with the variable-capacity hole via the guide hole.

Preferably, the second channel is defined in the annular slot by the fixed scroll end plate, the variable-capacity cylinder and the execution member.

Preferably, the scroll compressor further comprises a suction pipe;

the compression mechanism further comprises a suction cavity; and the variable-capacity cylinder is provided with an intake hole channel and a vent hole, the intake hole channel communicates with the suction pipe and the suction cavity so that the intake hole channel and the suction pipe form the low-pressure region, and the second channel communicates with the intake hole channel via the vent hole.

Preferably, a biasing device mounted between the fixed scroll end plate and the execution member is further comprised, the biasing device comprising a biasing member suitable for biasing the execution member towards a direction, away from the fixed scroll end plate.

Preferably, a sealing device suitable for sealing the plunger relative to the variable-capacity hole is further comprised.

Preferably, the sealing device comprises: a sealing groove provided on an outer circumferential surface of the plunger; a sealing ring disposed in the sealing groove; and a pressure introducing channel configured to penetrate through the plunger and the execution member.

Preferably, the pressure introducing channel is configured to introduce the high-pressure fluid supplied via the pressure channel to the sealing groove, so as to force the sealing ring to be opened and abuted against an inner cylinder surface of the variable-capacity hole.

Preferably, the execution member is an annular piston.

Preferably, the annular piston comprises a piston body and a fixing ring, fixedly connected together, a receiving hole being provided at the fixing ring;

the plunger comprises a plunger barrel portion and a flange portion extending outward from one end of the plunger barrel portion, in a radial direction of the plunger barrel portion; and the plunger is connected to the annular piston, such that the flange portion is disposed in an axial clearance formed by the piston body and the fixing ring, and the plunger barrel portion is inserted into the receiving hole.

Preferably, the axial clearance is greater than the axial thickness of the flange portion; and/or the inner diameter of the receiving hole is designed to be greater than the outer diameter of the plunger barrel portion.

Preferably, an accommodating hole is formed at an end, where the flange portion is disposed, of the plunger barrel portion; and a biasing member is provided, the biasing member being accommodated in the accommodating hole and preloaded, such that one end of the biasing member abuts against the piston body and the other end abuts against the plunger barrel portion, thereby biasing the plunger towards a direction, away from the annular piston.

Preferably, the variable-capacity cylinder and the fixed scroll are integrally formed.

In order to achieve one or more of the above objects, according to another aspect of the present invention, a scroll compressor is provided. The scroll compressor comprises a variable-capacity mechanism as described above.

According to the present invention, a single actuation device (e.g., a single execution mechanism such as a single annular piston) is employed in the variable-capacity mechanism to implement simultaneous (synchronous) action of multiple blocking members (e.g., multiple plungers). Therefore, for a compressor needing to open two or more variable-capacity holes, it may be controlled by a single set of control structures (actuation structure), so that the overall structure is simple and the reliability of capacity adjustment switching may be improved. In particular, for a scroll compressor using a symmetrical profile, it is possible to avoid power consumption caused by uneven gas force of a compression mechanism (specifically unbalanced force of an orbiting scroll) or leakage of a working fluid due to the opening or closing of a variable-capacity hole.

In addition, according to the present invention, since at least a part of a discharge channel of the variable-capacity mechanism is defined by a back surface (upper surface) of a fixed scroll, an annular piston and a variable-capacity cylinder (in other words, all discharge channels are not opened in the fixed scroll). Therefore, the effective area of the discharge channel is not limited to the fixed scroll structure, so that the discharge resistance and the power consumption may be reduced, and the performance of a scroll compressor having a variable-capacity function may be improved. On the other hand, since it is not necessary to process a radial working fluid discharge channel in the fixed scroll, the processing difficulty and the processing cost are also reduced.

In addition, according to the present invention, since a guide hole is provided and the guide hole and the variable-capacity hole together define a movement passage in which a blocking member (e.g., plunger) is suitable for moving, the action reliability of the plunger may be ensured to ensure the action reliability of the annular piston. At the same time, it is also possible to further reduce a radial fit clearance between the plunger and the variable-capacity hole, which is advantageous to improve the sealing property of a compression mechanism under a full-capacity operation state.

BRIEF DESCRIPTION OF THE DRAWINGS

The above and other objects, features and advantages of the present invention will become more apparent from the following detailed description of the embodiments of the present invention with reference to the accompanying drawings in which.

DESCRIPTION OF THE DRAWING REFERENCE SIGNS

Figure 1:
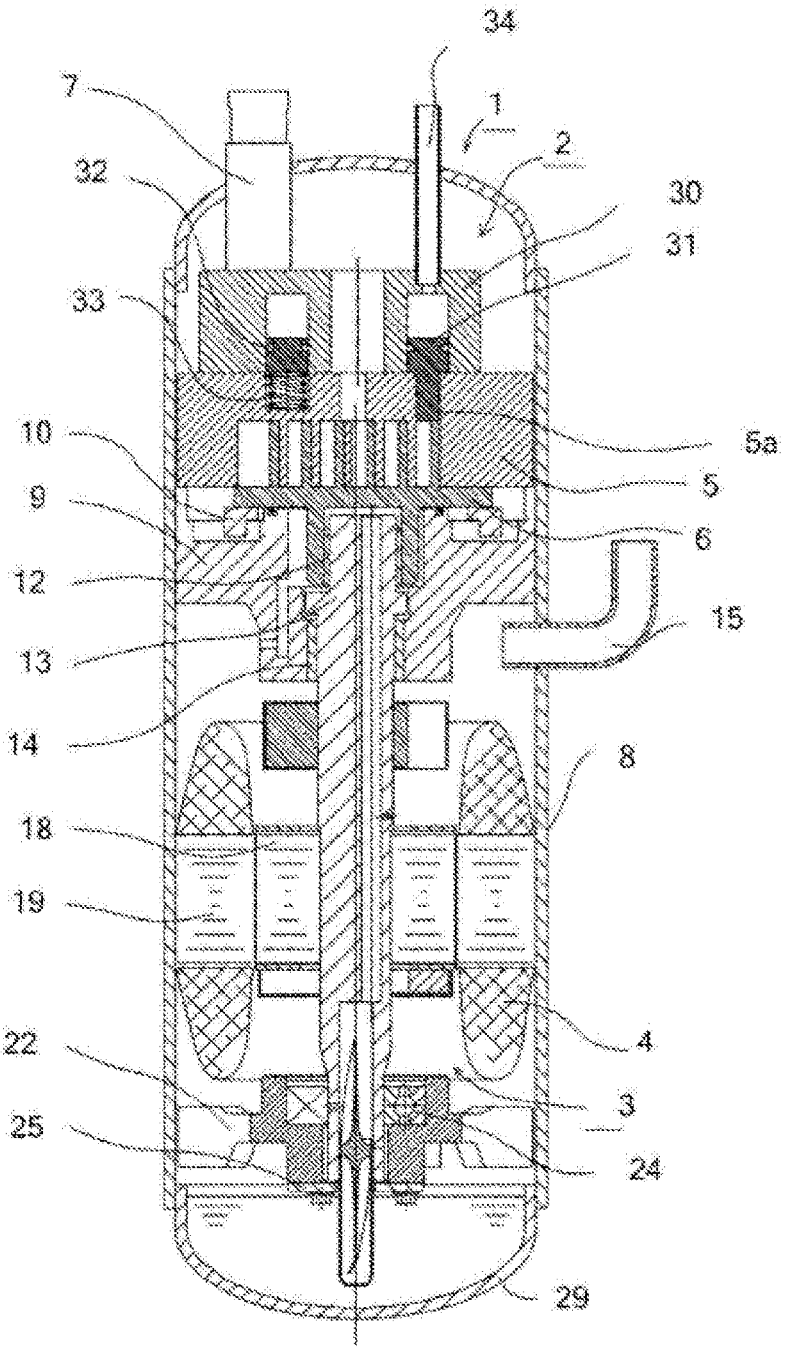
FIG. 1 is a longitudinal sectional view showing a scroll compressor including a variable-capacity mechanism according to a first embodiment of the present invention.

1—scroll compressor; 2—variable—capacity mechanism; 3—drive mechanism; 4—motor; 5—fixed scroll; 5*a*—variable—capacity hole; 5*b*—discharge hole; 5*c*—guide hole; 5*d*—mounting hole; 6—orbiting scroll; 7—suction pipe; 8—housing body; 9—main bearing seat; 10—autorotation prevention device; 12—drive bearing; 13—crankshaft; 14—main bearing; 15—exhaust pipe; 18—rotor; 19—stator; 22—supplementary bearing seat; 24—supplementary bearing; 25—thrust plate; 29—bottom cover; 30—variable—capacity cylinder; 30*a*—communication hole; 31—annular piston; 31*c, d*—groove; 31*e*—pressure introducing channel; 31*f*—sealing groove; 32—O sealing ring; 33—biasing member; 34—pressure channel; 35—sealing ring; 36—piston body; 37—plunger; 37*a*—plunger barrel portion; 37*b*—flange portion; 37*c*—tail end of plunger; 38—fixing plate; 38*a*—receiving hole; 39—axial compensation spring; 40—fastening bolt; G—annular slot; L—sealing device; P—discharge channel; P1—first channel; P2—second channel; PH—vent hole; U—pressurizing channel; S1—suction cavity; S2—intake hole channel.

DETAILED DESCRIPTION OF THE EMBODIMENTS

The present invention will be described in detail below with reference to the accompanying drawings by way of exemplary embodiments. The following detailed description of the present invention is provided for the purpose of illustration only, and is not intended to limit the present invention and its application or uses.

First, a scroll compressor 1 according to a first embodiment of the present invention and a variable-capacity mechanism 2 comprised in the scroll compressor 1 will be described with reference to FIG. 1 to FIG. 6.

The scroll compressor 1 may comprise: a housing assembly, a compression mechanism, a drive mechanism 3, a support mechanism, a suction pipe 7, and an exhaust pipe 15.

In the illustrated example, the scroll compressor 1 is shown as a fully-closed high-pressure side scroll compressor. However, it should be understood that the present invention is not limited to a totally-closed high-pressure side scroll compressor, but may also be applied to, for example, a totally-closed low-pressure side scroll compressor and a semi-closed scroll compressor.

The housing assembly may comprise a housing body 8, a top cover and a bottom cover 29, and may define a closed space for accommodating, for example, the compression mechanism and the drive mechanism 3.

The compression mechanism may comprise a fixed scroll 5, an orbiting scroll 6, and an autorotation prevention device 10. The fixed scroll 5 may comprise an end plate and a fixed scroll roll. A discharge port for discharging a compressed high-pressure working fluid from the compression mechanism may be disposed substantially at the center of the fixed scroll end plate. The orbiting scroll 6 may comprise an end plate and an orbiting scroll roll. A hub portion for accommodating an eccentric pin of a crankshaft (drive shaft) may be provided so as to protrude from a lower surface of the orbiting scroll end plate. The fixed scroll roll and the orbiting scroll roll may be engaged to define a series of compression cavities (working cavity) between the fixed scroll 5 and the orbiting scroll 6. The autorotation prevention device 10 may be implemented as an Oldham ring (cross sliding ring) for limiting the autorotation of the orbiting scroll 6 while allowing the orbiting scroll 6 to perform a rotational translational motion with respect to the fixed scroll 5.

The drive mechanism 3 may comprise a motor 4 composed of a stator 19 and a rotor 18, and a crankshaft 13. The crankshaft 13 may be provided to be able to rotate integrally with the rotor 18, and the crankshaft 13 may comprise an eccentric pin suitable for driving the orbiting scroll 6 at an upper end.

The support mechanism may comprise a main bearing seat 9 and a supplementary bearing seat 22. The main bearing seat 9 is suitable for axially supporting the orbiting scroll 6 (specifically supporting the orbiting scroll end plate). A main bearing 14 (e.g., implemented as a sliding bearing) may also be disposed at the main bearing seat 9, and the main bearing 14 is suitable for supporting an upper portion of the crankshaft 13. In some examples, a drive bearing 12 (e.g., implemented as a slide bearing) may be disposed between the hub portion of the orbiting scroll 6 and the eccentric pin of the crankshaft 13, such that the eccentric pin of the crankshaft 13 drives the hub portion of the orbiting scroll 6 via the drive bearing 12 to further drive a rotational translation of the orbiting scroll 6. A supplementary bearing 24 (e.g., implemented as a roller bearing) and a thrust plate 25 may also be disposed at the supplementary bearing seat 22, and used for radially and axially supporting a lower portion of the crankshaft 13.

The suction pipe 7 may be connected to the fixed scroll 5, so that a low-pressure working fluid from an external working circuit may flow via the suction pipe 7 to the compression mechanism for compression. The exhaust pipe 15 may be connected to the housing body 8 of the housing assembly, so that a high-pressure working fluid compressed by the compression mechanism may flow via the exhaust pipe 15 to the external working circuit.

The working process of the scroll compressor 1 will be briefly described below with reference to FIG. 1. When the motor 4 is energized, the rotor 18 rotates integrally with the crankshaft 13, so that the eccentric pin of the crankshaft 13 drives the hub portion of the orbiting scroll 6 via the drive bearing 12 to drive the orbiting scroll 6 to perform a rotational translational motion. Meanwhile, the working fluid enters the suction cavity S1 of the compression mechanism via the suction pipe 7 (see FIG. 5). As the orbiting scroll 6 continues to rotate and translate, the suction cavity S1 is closed to be a compression cavity and moves toward the center. The capacity is continuously reduced, so that the working fluid in the compression cavity is compressed to make the pressure rise. When a predetermined compression ratio is reached, the working fluid is discharged from a center discharge port of the fixed scroll 5 into an upper portion of the closed space defined by the housing assembly, enters a lower middle portion of the closed space via flow channels provided in the fixed scroll 5 and the main bearing seat 9, and then is discharged from the scroll compressor 1 via the exhaust pipe 15.

According to the first embodiment of the present invention, a variable-capacity mechanism 2 is disposed in the scroll compressor 1.

Figure 2:
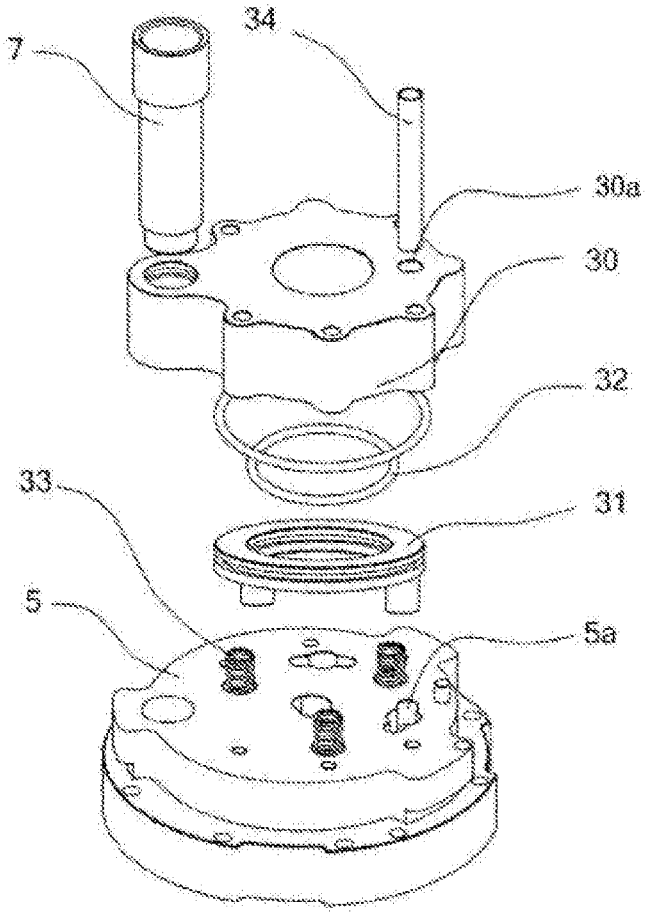
FIG. 2 is a three-dimensional exploded view showing a variable-capacity mechanism according to a first embodiment of the present invention.
Figure 3:
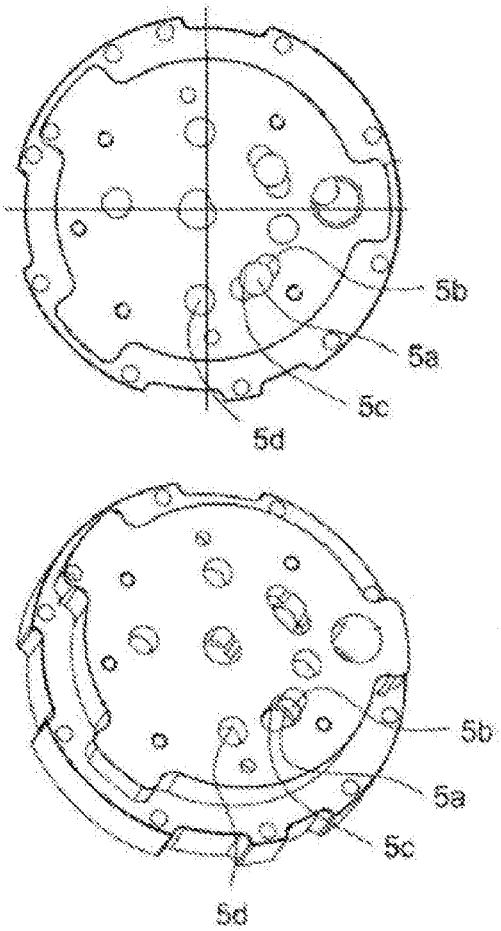
FIG. 3 is a top view and a three-dimensional view showing a fixed scroll according to a first embodiment of the present invention.
Figure 4:
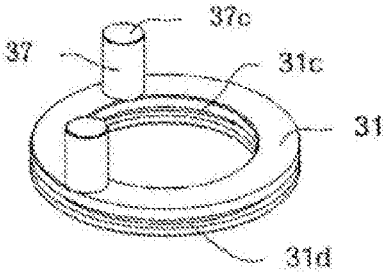
FIG. 4 is a three-dimensional view mainly showing an annular piston according to a first embodiment of the present invention.

As shown in FIG. 2, the variable-capacity mechanism 2 may comprise: a discharge channel (bypass channel) P, a blocking member, and an actuation device.

The discharge channel P is suitable for communicating a specific compression cavity of a compression mechanism (e.g., a medium-pressure compression cavity having a pressure between the pressure of a low-pressure suction cavity S1 and the pressure of a central high-pressure compression cavity to be discharged or being discharged) and the suction cavity S1 of the compression mechanism or other low-pressure fluid regions (low-pressure region). The discharge channel P may comprise a first channel P1 (see FIG. 6) formed at a fixed scroll end plate and a second channel P2 (see FIG. 6) defined by the fixed scroll end plate, a variable-capacity cylinder 30 of the variable-capacity mechanism 2 and an execution member (e.g., annular piston 31) of the actuation device.

The first channel P1 may comprise: a variable-capacity hole 5*a* formed at a lower portion of the fixed scroll end plate so as to be suitable for communicating with a specific compression cavity; and a discharge hole 5*b* formed at an upper portion of the fixed scroll end plate, so that a lower end is suitable for communicating (e.g., via a guide hole 5*c* to be described hereinafter) with the variable-capacity hole 5*a* and an upper end is suitable for communicating with the second channel P2.

In a preferred example, a guide hole 5*c* may also be provided. The guide hole 5*c* may be formed at the upper portion of the fixed scroll end plate. The lower end of the guide hole 5*c* may communicate with the upper end of the variable-capacity hole 5*a*, so that the guide hole 5*c* and the variable-capacity hole 5*a* define a movement passage suitable for the movement of the blocking member therein. The inner diameter of the guide hole 5*c* may be consistent with the inner diameter of the variable-capacity hole 5*a*, so that the guide hole 5*c* and the variable-capacity hole 5*a* can be smoothly engaged to form a movement passage having consistent inner diameters, which is advantageous to stably guide a plunger so as to make the action of the plunger more stable and reliable.

In a preferred example, a discharge hole 5*b* communicating with each variable-capacity hole 5*a* may be provided, the discharge hole 5*b* being provided on the upper side of the variable-capacity hole 5*a*. Preferably, two discharge holes 5*b* are provided on both sides of the variable-capacity hole 5*a*. The discharge hole 5*b* may be provided at a side portion of the guide hole 5*c*, and the discharge hole 5*b* is a blind hole partially overlapped with the guide hole 5*c* and communicating with the variable-capacity hole 5*a* via the guide hole 5*c*. By providing a pair of discharge holes 5*b*, the discharge resistance may be effectively reduced.

Figure 5:
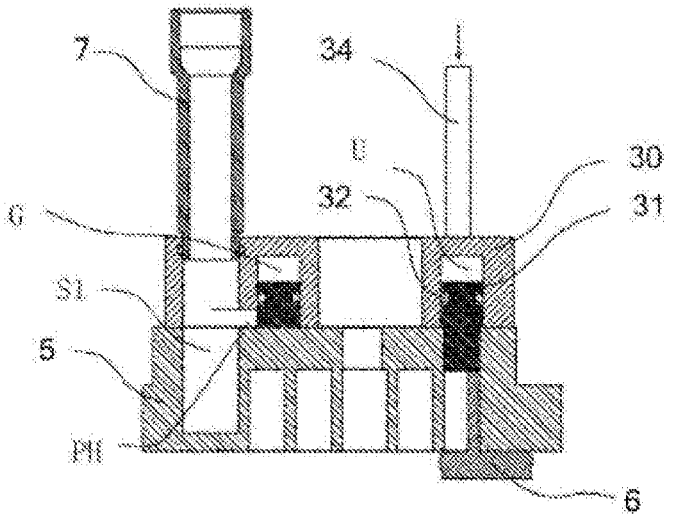
FIG. 5 is a sectional view showing a variable-capacity mechanism in a non variable-capacity state according to a first embodiment of the present invention.
Figure 6:
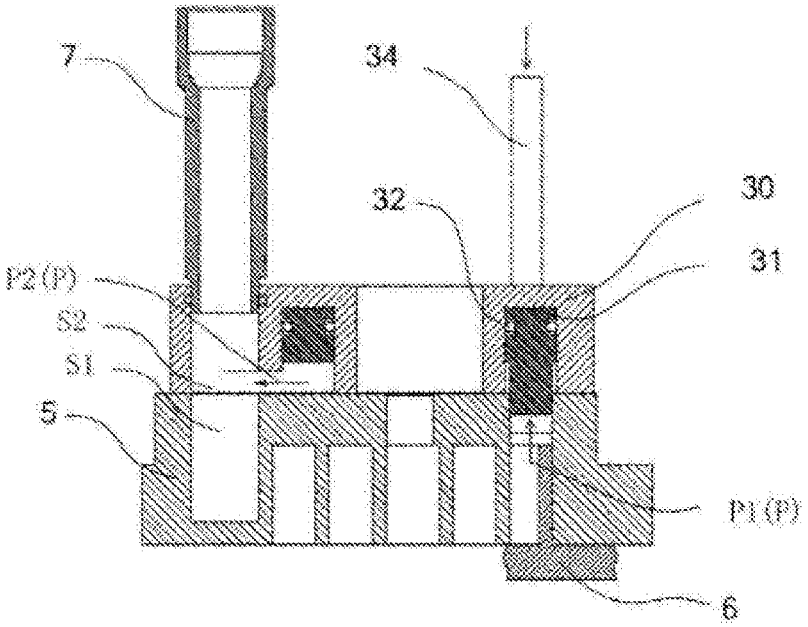
FIG. 6 is a sectional view showing a variable-capacity mechanism in a variable-capacity state according to a first embodiment of the present invention.

The blocking member may be implemented as a plunger 37 in a substantially cylindrical shape. The plunger 37 is suitable for moving in a movement passage defined by the guide hole 5*c* and the variable-capacity hole 5*a*, so as to be at a closed position and an open position. At the closed position, a tail end (lower end) 37*c* of the plunger 37 is located below the lower end of the discharge hole 5*b* (for example, as shown in FIG. 5, the tail end 37*c* of the plunger 37 abuts against a tail end (upper end) of the orbiting scroll roll of the orbiting scroll 6, thereby blocking the first channel P1 to prevent a medium pressure working fluid from being discharged from a specific compression cavity (medium-pressure compression cavity) to a low-pressure fluid region. At the open position, the tail end 37*c* of the plunger 37 is located above the lower end of the discharge hole 5*b* (as shown in FIG. 6), thereby opening the first channel P1 to allow the medium-pressure working fluid to be discharged from the specific compression cavity via the variable-capacity hole 5*a* and the discharge 5*b* (i.e., first channel P1) and the second channel P2 to the low-pressure fluid region.

The actuation device may comprise an execution member and a driver portion. The execution member may be implemented as an annular piston 31. An upper end of the plunger 37 may be fixedly connected, for example, to a lower surface of the annular piston 31.

In a preferred example, a variable-capacity cylinder 30 may be disposed in the variable-capacity mechanism 2. The variable-capacity cylinder 30 may be substantially annular. An annular slot G (see FIG. 5) open downwards (i.e., opened toward the compression mechanism) may be formed in the variable-capacity cylinder 30, and the annular piston 31 may be disposed in the annular slot G in an attached manner. In some examples, grooves 31*c*, 31*d* (see FIG. 4) may be provided on a radially inner circumferential surface and/or radially outer circumferential surface of the annular piston 31, and O sealing rings 32 may be disposed in the grooves, such that the annular piston 31 is joined to the annular slot G of the variable-capacity cylinder 30 in a sealing manner.

In a preferred example, the drive portion may comprise a pressure channel 34 and a high-pressure fluid supplied to the pressure channel 34. A lower end of the pressure channel 34 may be connected to a communication hole 30*a* (see FIG. 2) provided at the upper portion of the variable-capacity cylinder 30, so that the pressure channel 34 may communicate with the annular slot G (specifically, the upper portion of the annular slot G) via the communication hole 30*a*. The pressure channel 34 may be selectively supplied with a high-pressure fluid and a low-pressure fluid. When the pressure channel 34 is supplied with a high-pressure fluid, the high-pressure fluid supplied via the pressure channel 34 pushes the annular piston 31 downwards, thereby pushing the plunger 37 fixedly connected to the annular piston 31 downwards to be at the closed position. In some examples, the high-pressure fluid supplied to the pressure channel 34 may be a high-pressure working fluid compressed by the compression mechanism of the scroll compressor 1.

In a preferred example, a vent hole PH (see FIG. 5) may be provided at the variable-capacity cylinder 30, and the second channel P2 (specifically the lower portion of the annular channel G constituting the second channel P2) may communicate with a low-pressure fluid region (e.g., an intake hole channel of the variable-capacity cylinder 30 to be described hereinafter) via the vent hole PH.

In a preferred example, the variable-capacity cylinder 30 may also be provided with an intake hole channel S2 (see FIG. 6), so that the lower end of the suction pipe 7 may be connected to the upper end of the intake hole channel S2, and the lower end of the intake hole channel S2 may be connected to the suction cavity S1 provided at the fixed scroll 5 (the intake hole channel S2 of the variable-capacity cylinder 30 and the suction cavity S1 of the fixed scroll 5 may define a so-called suction region or low-pressure fluid region).

Thus, when the variable-capacity cylinder 30 is connected (e.g., hermetically and fixedly) to the upper surface of the fixed scroll end plate under a state in which the annular piston 31 is disposed in the annular slot G, on the one hand, a second channel P2 of the discharge channel P is defined at the lower portion of the annular slot G of the variable-capacity cylinder 30 by the upper surface of the fixed scroll end plate and the lower surface of the annular piston 31, and on the other hand, a pressurizing channel U is defined at the upper portion of the annular slot G of the variable-capacity cylinder 30 by the upper surface of the annular piston 31 (see FIG. 5).

In a preferred example, a biasing device may also be provided. The biasing device may comprise a biasing member 33 (e.g., implemented as a spring such as a coil spring) and a mounting hole 5*d* provided at the fixed scroll end plate and suitable for mounting the biasing member 33. The biasing member 33 is suitable for pushing the annular piston 31 upwards. Thus, when the scroll compressor 1 needs to perform a variable-capacity operation, for example, when the pressure channel 34 is supplied with a low-pressure fluid, the biasing member 33 can push the annular piston 31 together with the plunger 37, such that the plunger 37 is at the open position. Here, it should be pointed out that the biasing device may be omitted. In this case, the plunger 37 is pushed upwards together with the annular piston 31 by means of a pressure difference between the medium-pressure compression cavity and the low-pressure fluid region.

According to the first embodiment of the present invention, two or more variable-capacity holes 5*a* may be provided, and accordingly, two or more plungers 37 connected to the annular piston 31 may be provided in order to achieve a larger variable-capacity adjustment range.

In particular, according to the first embodiment of the present invention, a single actuation device (a single execution member such as a single annular piston 31) for two or more blocking members (plungers 37) is provided, such that two or more plungers 37 move with the movement of the single annular piston 31 simultaneously.

The working process of the variable-capacity mechanism 2 of the scroll compressor 1 according to the first embodiment of the present invention will be described below.

When the scroll compressor 1 needs to be operated in a non variable-capacity (full capacity) state, as shown in FIG. 5, a high-pressure fluid is supplied to the drive portion/pressure channel 34 of the actuation device (e.g., the pressure channel 34 selectively communicates with a high-pressure exhaust side of the scroll compressor 1). Thus, the high-pressure fluid supplied via the pressure channel 34 (e.g., against a biasing force of the biasing member 33) pushes the annular piston 31 downwards (at this time, the upper surface of the annular piston 31 defines a pressurizing channel at the upper portion of the annular slot G of the variable-capacity cylinder 30), so as to simultaneously push multiple plungers 37 fixedly connected to the annular piston 31 downwards to be at a closed position. Thus, the tail end 37*c* of the plunger 37 may abut against the tail end of the orbiting scroll roll of the orbiting scroll 6 to achieve axial sealing of a (medium-pressure) compression cavity. Meanwhile, the outer circumferential surface (cylindrical surface) of the plunger 37 fits the variable-capacity hole 5*a* to achieve radial sealing of the (medium-pressure) compression cavity. Thus, the variable-capacity hole 5*a* of the first channel is blocked to prevent a medium-pressure working fluid from being discharged from a specific compression cavity (medium-pressure compression cavity) to a low-pressure fluid region.

When the scroll compressor 1 needs to be operated in a variable-capacity (partial capacity/load) state, as shown in FIG. 6, a low-pressure fluid is supplied to the pressure channel 34 of the actuation device (e.g., the pressure channel 34 selectively communicates with a low-pressure exhaust side of the scroll compressor 1). Thus, the annular piston 31 and multiple plungers 37 can be pushed upwards by means of, for example, a biasing force of the biasing member 33 and/or by means of the medium pressure of a (medium-pressure) compression cavity to make the multiple plungers 37 at an open position simultaneously. Thus, the variable-capacity hole 5*a* of the first channel is opened to allow a medium-pressure working fluid to be discharged from a specific compression cavity via the variable-capacity hole 5*a* and the discharge hole 5*b* (i.e., first channel) and the second channel P2 to a low-pressure fluid region. Thus, the endpoint of a profile is changed, so as to reduce an intake capacity to an internal volume ratio (compression ratio) by shortening the length of the profile (i.e., advancing the endpoint of the profile) with an exhaust disengagement point unchanged, so as to achieve capacity adjustment of the scroll compressor 1.

The scroll compressor and the variable-capacity mechanism thereof according to the first embodiment of the present invention may at least obtain the following beneficial effects.

A single actuation device (e.g., a single execution mechanism such as a single annular piston) is employed in the variable-capacity mechanism to implement simultaneous (synchronous) action of multiple blocking members (e.g., multiple plungers). Therefore, for a compressor needing to open two or more variable-capacity holes, it may be controlled by a single set of control structures (actuation structure), so that the overall structure is simple and the reliability of capacity adjustment switching may be improved. In particular, for a scroll compressor using a symmetrical profile, it is possible to avoid power consumption caused by uneven gas force of a compression mechanism (specifically unbalanced force of an orbiting scroll) or leakage of a working fluid due to the opening or closing of a variable-capacity hole.

In addition, since at least a part of a discharge channel of the variable-capacity mechanism is defined by a back surface (upper surface) of a fixed scroll, an annular piston and a variable-capacity cylinder (in other words, all discharge channels are not opened in the fixed scroll). Therefore, the effective area of the discharge channel is not limited to the fixed scroll structure, so that the discharge resistance and the power consumption may be reduced, and the performance of a scroll compressor having a variable-capacity function may be improved. On the other hand, since it is not necessary to process a radial working fluid discharge channel in the fixed scroll, the processing difficulty and the processing cost are also reduced.

In addition, since a guide hole 5*c* is provided and the guide hole 5*c* and the variable-capacity hole 5*a* together define a movement passage in which a blocking member (e.g., plunger) is suitable for moving, the action reliability of the plunger may be ensured to ensure the action reliability of the annular piston. At the same time, it is also possible to further reduce a radial fit clearance between the plunger 37 and the variable-capacity hole 5*a*, which is advantageous to improve the sealing property of a compression mechanism under a full-capacity operation state.

Figure 7:
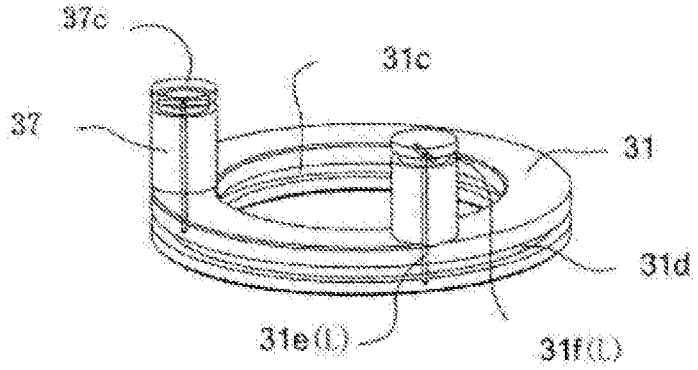
FIG. 7 is a three-dimensional view showing an annular piston and a plunger according to a second embodiment of the present invention.
Figure 8:
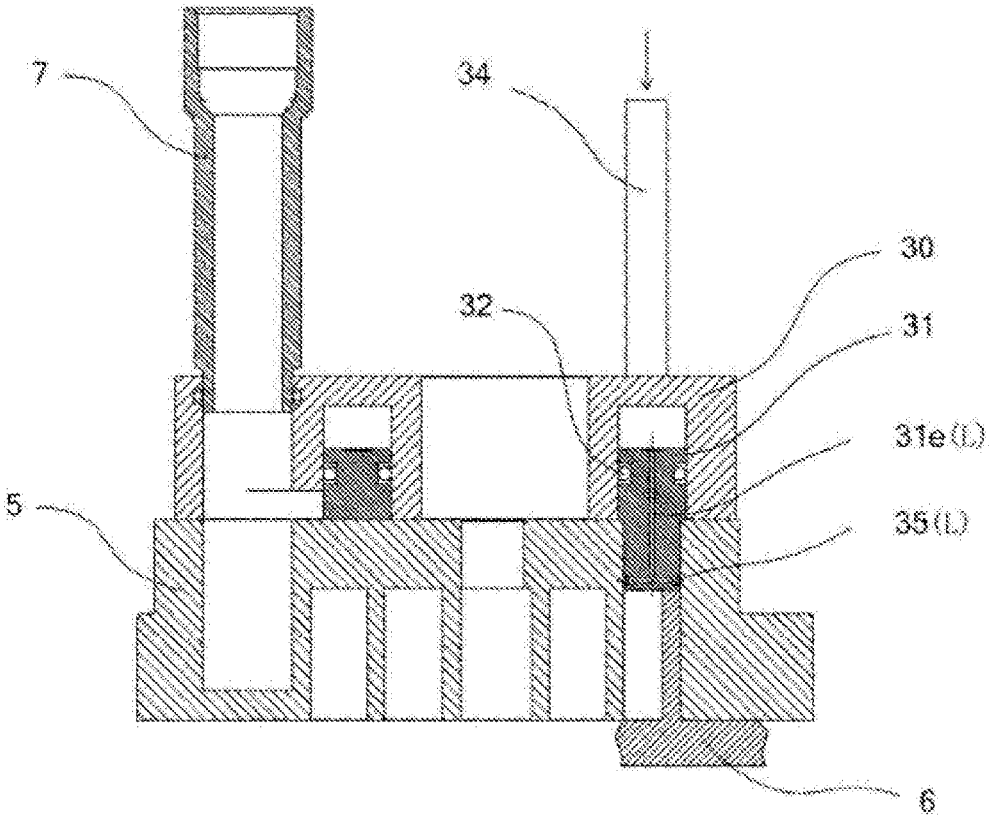
FIG. 8 is a sectional view showing a variable-capacity mechanism in a non variable-capacity state according to a second embodiment of the present invention.

The variable-capacity mechanism 2 according to a second embodiment of the present invention will be described below with reference to FIG. 7 and FIG. 8.

For the sake of brevity, the following will mainly describe the difference between the variable-capacity mechanism 2 according to the second embodiment of the present invention and the variable-capacity mechanism 2 according to the first embodiment of the present invention.

Compared with the first embodiment, in the variable-capacity mechanism 2 according to the second embodiment, a sealing device L is added to the plunger 37. The sealing device L may comprise: a sealing groove 31*f* provided on an outer circumferential surface of the plunger 37; a sealing ring 35 disposed in the sealing groove 31*f*; and a pressure introducing channel 31*e* disposed inside the plunger 37 and the annular piston 31. The pressure introducing channel 31*e* may comprise an axial channel, axially penetrating through the annular piston 31, so that one end (upper end) of the axial channel is opened from the upper surface of the annular piston 31. The pressure introducing channel 31*e* may further comprise one or more radial channels, extending to the sealing groove 31*f* from the lower end of the axial channel. Thus, when the scroll compressor 1 is operated in a full capacity state, a high-pressure fluid introduced from the pressure channel 34 enters the pressure introducing channel 31*e* via a pressurizing channel and enters the sealing groove 31*f*, thereby forcing the sealing ring 35 to be opened and abuted against an inner cylinder surface of the variable-capacity hole 5*a* at the fixed scroll 5.

In some examples, the sealing ring 35 may be implemented as a sealing ring having a U-shaped cross section and having an inward opening of the U-shaped cross section. Thus, when the high-pressure fluid is introduced into the sealing groove 31*f*, the sealing ring 35 may be effectively opened and abuted against the inner cylinder surface of the variable-capacity hole 5*a* so as to improve the sealing property.

According to the second embodiment of the present invention, in addition to the above-described beneficial effects associated with the first embodiment of the present invention, the following beneficial effects may also be obtained.

Since the sealing device L assisted by the high-pressure fluid is additionally provided, clearance leakage between the outer cylinder surface of the plunger 37 and the inner cylinder surface of the variable-capacity hole 5*a* may be reduced at the time of full-capacity operation, thereby improving the sealing property of the compression mechanism so as to improve the energy efficiency of the compressor. On the other hand, when the scroll compressor is switched from a full capacity state to a partial capacity state, the supply of the high pressure fluid is shut off, and the sealing ring 35 is appropriately retracted to also facilitate the smooth movement of the plunger 37 to the open position.

Figure 9:
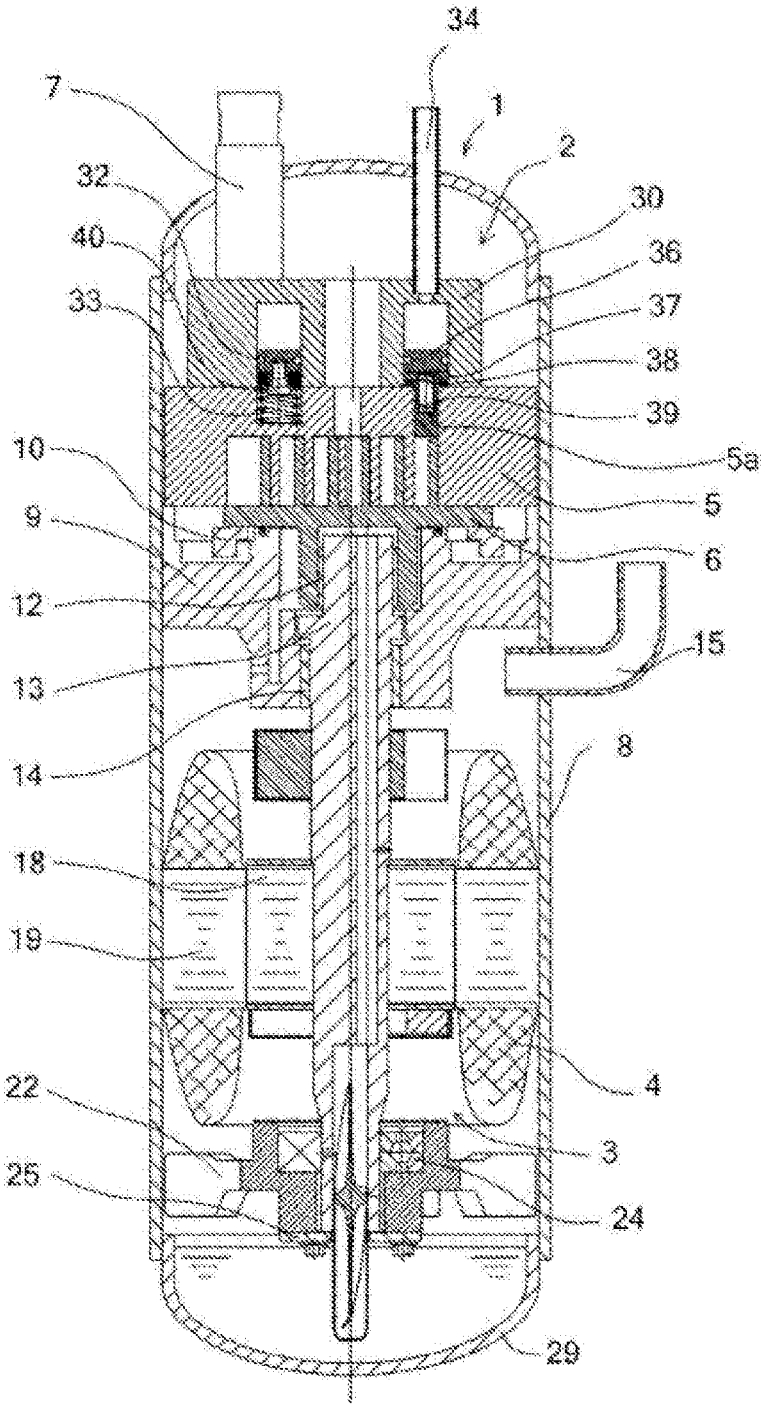
FIG. 9 is a longitudinal sectional view showing a scroll compressor including a variable-capacity mechanism according to a third embodiment of the present invention.
Figure 10:
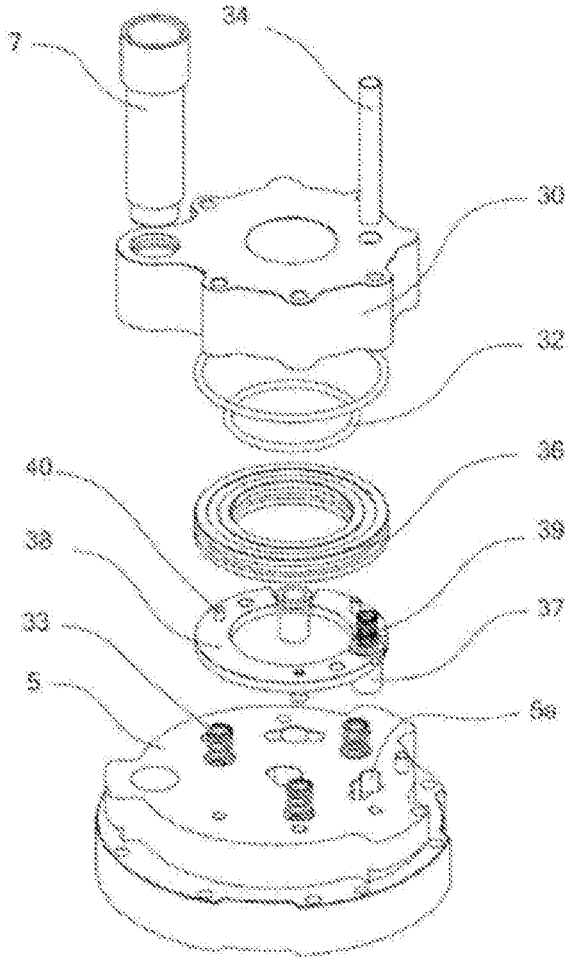
FIG. 10 is a three-dimensional exploded view showing a variable-capacity mechanism according to a third embodiment of the present invention.
Figure 13:
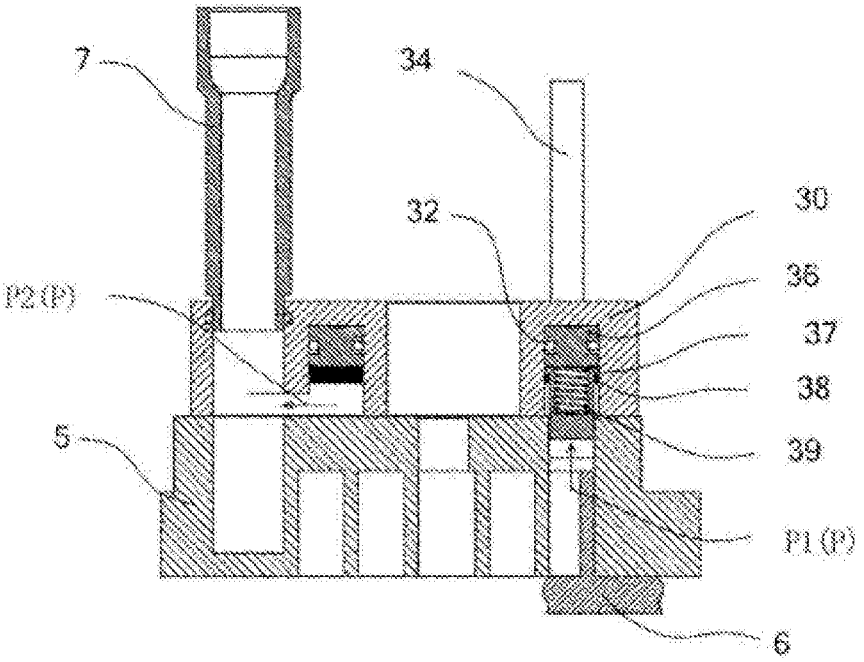
FIG. 13 is a sectional view showing a variable-capacity mechanism in a variable-capacity state according to a third embodiment of the present invention.

The variable-capacity mechanism 2 according to a third embodiment of the present invention will be described below with reference to FIG. 9 and FIG. 13.

For the sake of brevity, the following will mainly describe the difference between the variable-capacity mechanism 2 according to the third embodiment of the present invention and the variable-capacity mechanism 2 according to the first embodiment of the present invention.

Compared with the first embodiment, in the variable-capacity mechanism 2 according to the third embodiment, the annular piston 31 serving as an execution member of the actuation device takes the form of a split annular piston, such that the plunger 37 has, with respect to the radial flexibility and axial flexibility of the annular piston 31, the characteristic of adjustability.

Figure 11:
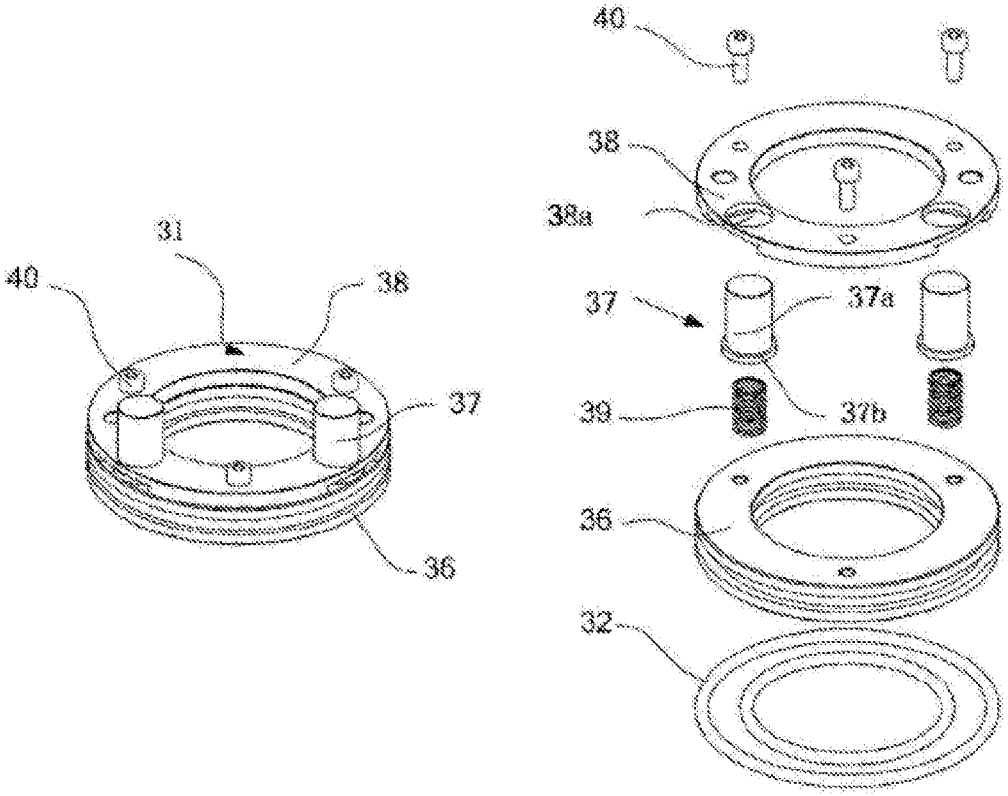
FIG. 11 is a three-dimensional assembly view and a three-dimensional exploded view mainly showing an annular piston according to a third embodiment of the present invention.

As shown in FIG. 11, the annular piston 31 may comprise a ring (piston body) 36, a fixing plate (fixing ring) 38, a fastening bolt 40 and an O sealing ring 32. The fastening bolt 40 is suitable for fixedly connecting the fixing plate 38 and the ring 36 together so as to form the annular piston 31. A receiving hole 38*a* suitable for receiving a part of the plunger 37 may be provided at the fixing plate 38.

The plunger 37 may comprise a plunger barrel portion 37*a* (see FIG. 11). An accommodating hole may be provided at an axial end of the plunger barrel portion 37*a*, and a flange portion 37*b* extending radially outwards from the plunger barrel portion 37*a* is disposed at the axial end (see FIG. 11). The flange portion 37*b* is suitable for preventing the plunger 37 from disengaging from the annular piston 31.

An axial compensation spring (biasing member) 39 is provided, the spring 39 being accommodated in the accommodating hole at the plunger 37.

Figure 12:
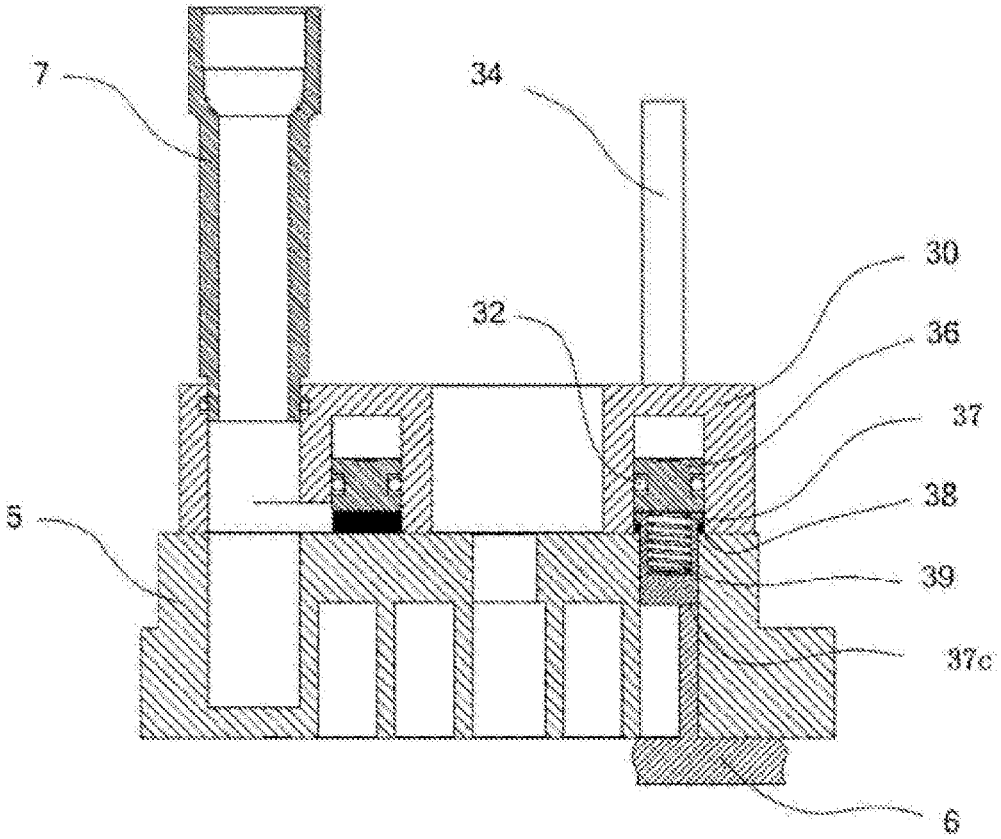
FIG. 12 is a sectional view showing a variable-capacity mechanism in a non variable-capacity state according to a third embodiment of the present invention.

As shown in FIG. 12, in an assembled state of the annular piston 31 and the plunger 37, the flange portion 37*b* of the plunger 37 is disposed in an axial clearance formed by the ring 36 and the fixing plate 38 and is sandwiched between the ring 36 and the fixing plate 38, and the plunger barrel portion 37*a* of the plunger 37 is inserted into the receiving hole 38*a*. Meanwhile, the spring 39 is disposed in the receiving hole at the plunger 37 and preloaded, so that one end (upper end) of the spring 39 abuts against the lower surface of the ring 36 and the other end (lower end) abuts against the plunger 37, thereby biasing the plunger 37 away from the annular piston 31.

In particular, according to the third embodiment, the axial clearance formed by the ring 36 and the fixing plate 38 is designed to be greater than the axial thickness of the flange portion 37*b*, and/or, the inner diameter of the receiving hole 38*a* is designed to be greater than the outer diameter of the plunger barrel portion 37*a* (that is, a larger fit clearance is adopted between the plunger 37 and the fixing plate 38 in a radial direction). In other words, in the assembled state of the annular piston 31 and the plunger 37, the plunger 37 is allowed to be axially displaced relative to the annular piston 31, and/or, the plunger 37 is allowed to be radially displaced relative to the annular piston 31.

According to the third embodiment of the present invention, in addition to the above-described beneficial effects associated with the first embodiment of the present invention, the following beneficial effects may also be obtained.

On the one hand, since a larger fit clearance is adopted between the plunger 37 and the fixing plate 38 in a radial direction, the plunger 37 is adjustable in the radial direction, so that it is possible to eliminate the problem of over-positioning between two or more plungers 37 and the ring 36 under the state of being inserted into respective variable-capacity holes 5*a*. On the other hand, since a larger fit clearance is adopted between the plunger 37 (specifically, the flange portion 37*b* of the plunger 37) and the fixing plate 38 as well as the ring 36 (specifically, an axial clearance formed by the ring 36 and the fixing plate 38) in an axial direction, the plunger 37 is adjustable in the axial direction. In particular, since the axial compensation spring 39 is disposed between the plunger 37 and the ring 36, the plunger 37 always protrudes toward the tail end of the orbiting scroll roll of the orbiting scroll 6 under the action of the spring 39. Thus, the tail end of the plunger 37 is always abut against the tail end of the orbiting scroll roll of the orbiting scroll 6, whereby the sealing property is improved whilst the situation of mutual interference between the tail end of the plunger 37 and the tail end of the orbiting scroll roll of the orbiting scroll 6 under, for example, an abnormal working state is also avoided.

In summary, according to the third embodiment of the present invention, the plunger has the characteristics of radial flexibility and axial flexibility, so that the problem of over-positioning may be eliminated to reduce the assembly difficulty and the part processing accuracy. In addition, under the action of the spring, the tail end of the plunger is abuted against the tail end of the orbiting scroll roll, thereby facilitating the axial sealing of the compression mechanism and also preventing the plunger and the orbiting scroll from interfering with each other.

Figure 14:
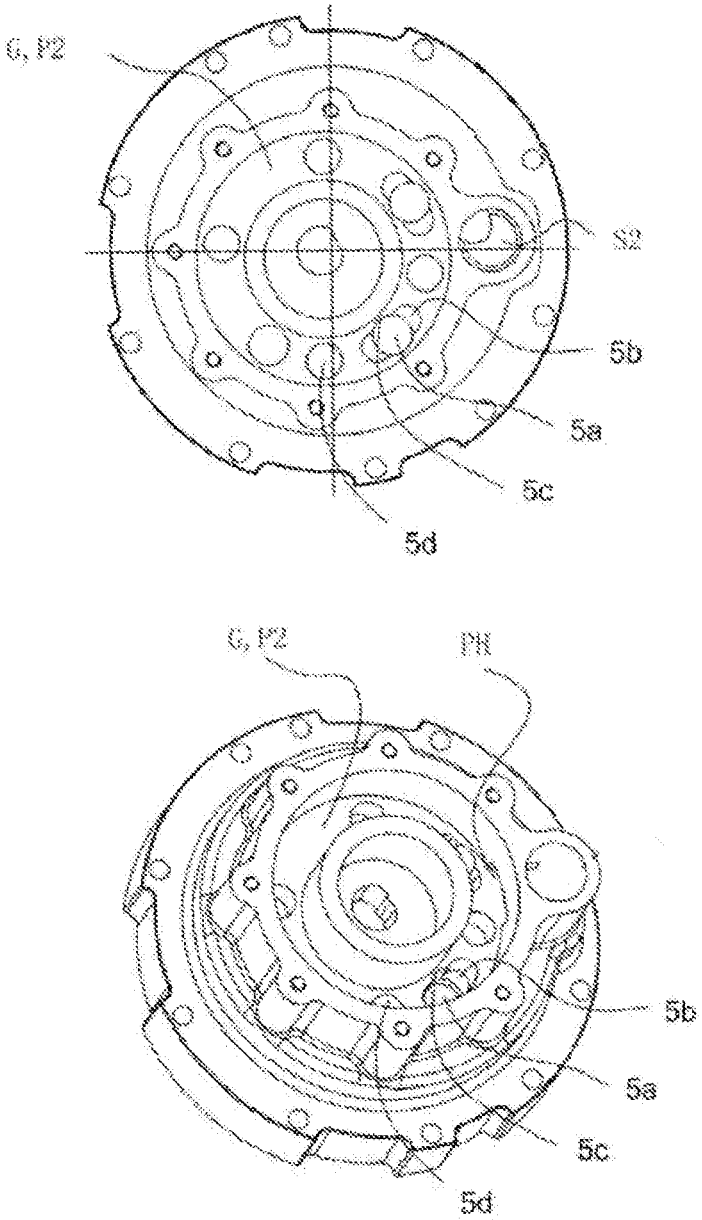
FIG. 14 is a top view and a three-dimensional view showing a fixed scroll according to a fourth embodiment of the present invention.

The variable-capacity mechanism 2 according to a fourth embodiment of the present invention will be described below with reference to FIG. 14.

For the sake of brevity, the following will mainly describe the difference between the variable-capacity mechanism 2 according to the fourth embodiment of the present invention and the variable-capacity mechanism 2 according to the first embodiment of the present invention.

Compared with the first embodiment, in the variable-capacity mechanism 2 according to the fourth embodiment, the variable-capacity cylinder 30 and the fixed scroll 5 are integrally formed. In other words, the back surface of the fixed scroll 5 is integrally formed with parts of the variable-capacity cylinder 30. As shown in FIG. 14, the annular slot G and the vent hole PH are integrally formed on the back surface of the fixed scroll 5.

In some examples, it is also possible to integrally form a cover body covering the variable-capacity cylinder. In other examples, the cover body may be formed separately and then the cover body is connected to the variable-capacity cylinder in a sealing manner.

According to the fourth embodiment of the present invention, in addition to the above-described beneficial effects associated with the first embodiment of the present invention, the following beneficial effects may also be obtained.

Since the variable-capacity cylinder 30 and the fixed scroll 5 are formed integrally, parts such as positioning pins and bolts for positioning and connecting the variable-capacity cylinder 30 may be reduced, and positioning problems are not taken into consideration, which is advantageous for processing and assembly, particularly applicable to mass production.

The variable-capacity mechanism according to the present invention allows for many different variations.

The actuation device of the variable-capacity mechanism 2 described above adopts a pressure channel 34 and a high-pressure fluid as a drive portion. However, it is conceivable that the actuation device may be implemented in other suitable forms. For example, a solenoid device may be provided such that an active plunger of the solenoid device drives a single execution member (annular piston).

The execution member of the variable-capacity mechanism 2 described above is implemented as an annular piston 31. However, it is conceivable that the execution member may be implemented in other suitable forms. For example, an arc-shaped segmented piston in a form of not-complete circular ring may be provided as a single execution member, a single execution member in a form of straight plate may be provided, or a single execution member in a form of bent plate may be provided. As long as multiple blocking members (e.g., plunger) are connected to the single execution member, the multiple blocking members move simultaneously with the movement of the single execution member.

What is described above is that at least a part of the discharge channels P is disposed outside the fixed scroll. However, it is conceivable that all of the discharge channels may be disposed in a fixed scroll (original fixed scroll). In this case, a single actuation device for multiple blocking members may still be provided to achieve the technical effect of simultaneous action of multiple blocking members.

The blocking member described above is implemented as a plunger 37. However, it is conceivable that the blocking member may be implemented in other suitable forms. For example, a valve plate and a valve seat may be provided as the blocking member, and each valve plate may be connected to a single execution member.

In addition, it may be understood that the sealing device L according to the second embodiment of the present invention and radially and axially flexible structures (i.e., a split annular piston 31 and a plunger 37) according to the third embodiment of the present invention may be implemented independently from the related structure of other embodiments (such as first embodiment). For example, the sealing device L according to the second embodiment of the present invention may be implemented in a variable-capacity mechanism having multiple blocking members and multiple corresponding execution members, and for example, the radially and axially flexible structures according to the third embodiment of the present invention may be implemented in a variable-capacity mechanism having a single blocking member and a single execution member.

It should be noted that in the present application, orientation terms "top", "bottom", "upper", "lower" and the like are used for convenience of description only and should not be construed as limiting. In particular, in the present specification, "upper" and "lower" are generally determined with reference to the orientation of the scroll compressor as shown in FIG. 1 and FIG. 9.

It should also be noted that in the present application, relational terms such as "first" and "second" are only used to distinguish a certain entity or operation from another entity or operation, and it is not necessary to require or imply that there is any such actual relationship or order between these entities or operations. In addition, the terms "comprise", "contain" or any other variations thereof are intended to cover a non-exclusive inclusion, such that a process, method, article or equipment comprising a series of elements not only comprises those elements, but also comprises those elements that are not explicitly listed, or comprises elements inherent to such a process, method, article or equipment.

It should also be noted that in this specification, whenever reference is made to "exemplary embodiments", "some examples", "other examples", "preferred examples" and "illustrated examples", etc., specific features, structures, or characteristics described by the embodiments/examples are comprised in at least one embodiment/example of the present invention. The appearances of these terms in various places in the specification do not necessarily all refer to the same embodiment/example. In addition, when a specific feature, structure or characteristic is described with respect to any embodiment/example, it should be considered that those skilled in the art can also implement such a feature, structure or characteristic in all other embodiments/examples among all the embodiments/examples.

Finally, it should be noted that it is obvious that the above-mentioned embodiments/examples are merely examples for clearly illustrating the present invention, and do not limit the embodiments/examples. For those skilled in the art, other variations or changes may also be made on the basis of the above description. There is no need of exhaustion for all of the embodiments/examples. Obvious variations or changes derived therefrom are still within the protection scope of the present invention.

What is claimed is:

1. A variable-capacity mechanism (2) for a scroll compressor (1), the scroll compressor (1) comprising a compression mechanism for compressing a working fluid, the compression mechanism comprising a fixed scroll (5) and an orbiting scroll (6) for defining a series of compression cavities between the fixed scroll (5) and the orbiting scroll (6), wherein, the variable-capacity mechanism (2) comprises:

a discharge channel (P), the discharge channel (P) being for communicating a medium-pressure compression cavity in the series of compression cavities with a low-pressure region;

a plurality of blocking members, the plurality of blocking members being for selectively opening or closing the discharge channel (P); and an actuation device, the actuation device comprising an execution member, the plurality of blocking members being connected to the execution member so as to selectively open or close the discharge channel (P) along with the actions of the execution member, wherein there is a single execution member, the plurality of blocking members are connected to the single execution member so as to synchronously move along with the actions of the single execution member, and each of the plurality of blocking members is a plunger (37), wherein the actuation device further comprises a drive portion, the drive portion comprising a pressure channel (34), the pressure channel (34) being selectively supplied with a high-pressure fluid and a low-pressure fluid; and when the pressure channel (34) is supplied with the high-pressure fluid, the high-pressure fluid pushes the single execution member (31) to actuate the single execution member (31).

2. A scroll compressor (1), the scroll compressor (1) comprising the variable-capacity mechanism (2) as claimed in claim 1.

3. The variable-capacity mechanism (2) as claimed in claim 1, wherein one end of the plurality of plungers (37) is connected to a lower surface of the single execution member.

4. The variable-capacity mechanism (2) as claimed in claim 3, wherein the single execution member is an annular piston (31).

5. The variable-capacity mechanism (2) as claimed in claim 4, wherein the annular piston (31) comprises a piston body (36) and a fixing ring (38), fixedly connected together, a plurality of receiving holes (38*a*) being provided at the fixing ring (38);

each plunger of the plurality of plungers (37) comprises a plunger barrel portion (37*a*) and a flange portion (37*b*) extending outward from one end of the plunger barrel portion (37*a*), in a radial direction of the plunger barrel portion (37*a*); and the plurality of plungers (37) are connected to the annular piston (31), such that each respective flange portion (37*b*) is disposed in an axial clearance formed by the piston body (36) and the fixing ring (38), and each respective plunger barrel portion (37*a*) is inserted into its respective receiving hole (38*a*).

6. The variable-capacity mechanism (2) as claimed in claim 5, wherein the axial clearance is greater than the axial thickness of the flange portion (37*b*); and/or the inner diameter of the receiving hole (38*a*) is greater than the outer diameter of the plunger barrel portion (37*a*).

7. The variable-capacity mechanism (2) as claimed in claim 6, wherein an accommodating hole is formed at an end of the plunger barrel portion $(37a)_7$ where the flange portion (37*b*) is disposed; and a biasing member (39) is provided, the biasing member (39) being accommodated in the accommodating hole and preloaded, such that one end of the biasing member (39) abuts against the piston body (36) and the other end abuts against the plunger barrel portion (37*a*), thereby biasing the plunger (37) towards a direction, away from the annular piston (31).

8. The variable-capacity mechanism (2) as claimed in claim 1, further comprising a variable-capacity cylinder (30) connected to a fixed scroll end plate of the fixed scroll (5).

9. The variable-capacity mechanism (2) as claimed in claim 8, further comprising: a biasing device mounted between the fixed scroll end plate and the single execution member, the biasing device comprising a biasing member (33) for biasing the single execution member (31), away from the fixed scroll end plate.

10. The variable-capacity mechanism (2) as claimed in claim 8, wherein the variable-capacity cylinder (30) and the fixed scroll (5) are integrally formed.

11. The variable-capacity mechanism (2) as claimed in claim 8, wherein an annular slot (G) opened toward the fixed scroll end plate is formed in the variable-capacity cylinder (30), the single execution member (31) being disposed in the annular slot (G).

12. The variable-capacity mechanism (2) as claimed in claim 11, wherein a communication hole (30*a*) is formed in the variable-capacity cylinder (30), and the pressure channel (34) communicates with the annular slot (G) via the communication hole (30*a*) so as to introduce the high-pressure fluid to an upper portion of the annular slot (G) to drive the single execution member (31).

13. The variable-capacity mechanism (2) as claimed in claim 12, wherein the discharge channel (P) comprises: a plurality of first channels (P1) formed on the fixed scroll end plate and capable of communicating with the medium-pressure compression cavity; and a second channel (P2) disposed on the variable-capacity cylinder (30) and capable of communicating with the plurality of first channels (P1) and the low-pressure region.

14. The variable-capacity mechanism (2) as claimed in claim 8, wherein each of the plurality of first channels (P1) comprises a variable-capacity hole (5*a*) and a discharge hole (5*b*) communicating with each other, wherein the variable-capacity hole (5*a*) is formed at a lower portion of the fixed scroll end plate so as to communicate with the medium-pressure compression cavity, and the discharge hole (5*b*) is formed at an upper portion of the fixed scroll end plate; and the plurality of plungers (37) is-selectively opening and closing the variable-capacity holes (5*a*).

15. The variable-capacity mechanism (2) as claimed in claim 14, further comprising: a sealing device (L) for sealing each respective plunger (37) relative to its variable-capacity hole (5*a*).

16. The variable-capacity mechanism (2) as claimed in claim 15, wherein the sealing device (L) comprises: a sealing groove (31*f*) provided on an outer circumferential surface of the plunger (37); a sealing ring (35) disposed in the sealing groove (31*f*); and a pressure introducing channel (31*e*) configured to penetrate through the plunger (37) and the single execution member (31).

17. The variable-capacity mechanism (2) as claimed in claim 16, wherein the pressure introducing channel (31*e*) is configured to introduce the high-pressure fluid supplied via the pressure channel (34) to the sealing groove (31*f*), so as to force the sealing ring (35) to be abutted against an inner cylinder surface of the variable-capacity hole (5*a*).

18. The variable-capacity mechanism (2) as claimed in claim 14, each of the plurality of first channels further comprising: a guide hole (5*c*), the guide hole (5*c*) being formed at the upper portion of the fixed scroll end plate and capable of communicating with the variable-capacity hole (5*a*), so that the guide hole (5*c*) and the variable-capacity hole (5*a*) define a movement passage for the movement of the respective plunger (37) therein.

19. The variable-capacity mechanism (2) as claimed in claim 18, wherein the discharge hole (5*b*) is provided at an upper side of the variable-capacity hole (5*a*), the discharge hole (5*b*) is a blind hole, and the discharge hole (5*b*) is partially overlapped with the guide hole (5*c*) and communicates with the variable-capacity hole (5*a*) via the guide hole (5*c*).

20. The variable-capacity mechanism (2) as claimed in claim 19, wherein the second channel (P2) is defined in the annular slot (G) by the fixed scroll end plate, the variable-capacity cylinder (30) and the single execution member (31).

21. The variable-capacity mechanism (2) as claimed in claim 20, wherein the scroll compressor further comprises a suction pipe (7);

the compression mechanism further comprises a suction cavity (S1); and the variable-capacity cylinder (30) is provided with an intake hole channel (S2) and a vent hole (PH), the intake hole channel (S2) communicates with the suction pipe (7) and the suction cavity (S1) so that the intake hole channel (S2) and the suction pipe (7) form the low-pressure region, and the second channel (P2) communicates with the intake hole channel (S2) via the vent hole (PH).

* * * * *